United States Patent [19]

Burstrom et al.

[11] 4,085,605

[45] Apr. 25, 1978

[54] METHOD AND APPARATUS FOR PLASTIC DEFORMATION AT HIGH AMBIENT PRESSURE

[75] Inventors: Martin Burstrom; Hans Larker; Jan Nilsson, all of Robertsfors, Sweden

[73] Assignee: ASEA AB, Vesteras, Sweden

[21] Appl. No.: 773,272

[22] Filed: Mar. 1, 1977

[30] Foreign Application Priority Data

Mar. 4, 1976 Sweden ..... 7603002

[51] Int. Cl.[2] ..... B21D 22/10

[52] U.S. Cl. ..... 72/54; 72/378

[58] Field of Search ..... 72/54, 57, 60, 63, 302, 72/378; 29/421 R

[56] References Cited

U.S. PATENT DOCUMENTS

| | | | |
|---|---|---|---|
| 2,136,538 | 11/1938 | Borwick | 72/378 X |
| 3,051,217 | 8/1962 | Hill et al. | 72/302 |
| 3,751,955 | 8/1973 | Stromblad | 72/60 |

*Primary Examiner*—Leon Gilden

*Attorney, Agent, or Firm*—Watson, Cole, Grindle & Watson

[57] ABSTRACT

Method and apparatus for plastically de-forming material in a high pressure cylinder, the material being preformed into a mandrel billet with an attachment portion and a piston at respective opposite ends thereof and interconnected by an intermediate portion having a smaller cross section than the piston. Holder structure releasably mounted within the high pressure cylinder adjacent the pressure chamber retains the mandrel billet and includes securing means at one end for retaining the attachment portion and engagement means at the other end for slidably engaging the piston. Pressurization of the pressure chamber generates an increase in the pressure medium which acts on the transition surface between the intermediate portion and the piston to cause an elongation of the intermediate portion of the mandrel billet.

5 Claims, 1 Drawing Figure

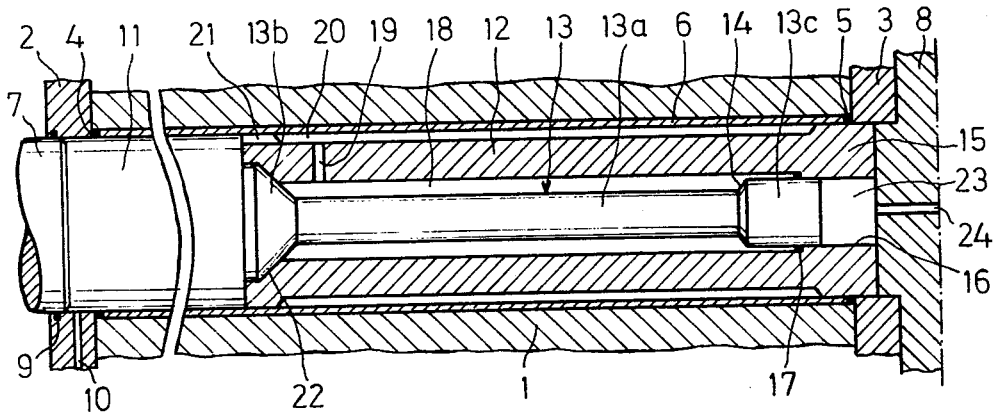
2
4
11
21
13b
20
19
18
12
13
13a
6
14
13c
5
3
8
7
15
23
24
16
9
10
22
1
17

METHOD AND APPARATUS FOR PLASTIC DEFORMATION AT HIGH AMBIENT PRESSURE

FIELD OF THE INVENTION

The present invention relates to a method and apparatus for plastically deforming rod-formed material under high ambient pressure to increase the yield stress point and the ultimate strength of the material.

BACKGROUND OF THE INVENTION

It is known that materials acquire better machining properties during plastic deformation at a high ambient pressure. Such knowledge has been used for forging materials which are difficult to forge by performing the forging operation at a high ambient pressure. Such forging under high ambient pressure is described in U. S. Pat. No. 3,286,337. It is further known that the strength properties of materials can be improved by plastic deformation so that the yield stress point and ultimate strength of the materials are increased.

SUMMARY OF THE INVENTION

According to the invention, a rod is formed so that an attachment portion is formed at one end. This rod is inserted into a tubular holder having a seat adjusted to the attachment portion and a groove adjusted to the other end of the rod. Preferably, this other end projecting into the groove is formed as a piston with a larger cross-section than the rod portion between the attachment portion and the piston portion, but the whole rod, except the attachment portion, may have the same cross-section. An annular differential piston area is then formed at the transition between the different cross-sections. The piston portion and the groove have cylindrical cross-sections for practical reasons, but may have other cross-sections. The holder is placed in a pressure chamber so that the cylinder groove outside the piston end of the rod communicates with the atmosphere outside the pressure chamber. The pressure chamber is filled with a pressurized pressure medium. The piston end of the rod forms a differential piston where the transition between the different cross-sections of the rod forms the annular piston surface. The pressure medium acting on this piston surface generates a tensile force by means of which a permanent elongation of the rod can be achieved. The elongation is usually performed at an ambient pressure exceeding 100 MPa (1000 bar) and exceeds 5%. When treating superalloys the material is suitably elongated by 10 - 20%.

The method and apparatus of the invention have been applied successfully in the manufacture of mandrels intended to be used in a hydrostatic extrusion press for manufacturing tubes. In the use of a mandrel treated in this way, an elongation of the mandrel when used in a press is avoided, and no change of the size of the annular forming space between the wall of the die orifice and the tip of the mandrel occurs. The same wall thickness is achieved in tubes pressed at different press cycles. The mandrel material is a nickel-based superalloy with the following composition: C 0.05–0.09%, Mn 0–0.02%, Si 0–0.10%, Cr 11.0–14.0%, Co 16.0–19.0%, Fe 0–1.0%, Mo 2.0–4.0%, W 0–0.2%, Ti 4.3–5.0%, Al 5.0–6.0%, V 0.7–1.2%, B 0.01–0.03%, Zr 0.03–0.09%, S <0.015%, P <0.015%, the remainder is Ni.

The invention also relates to equipment for carrying out the method. This includes a pressure chamber and a tubular holder, insertable therein, with a seat adjusted to the attachment portion of the rod and a groove adjusted to the piston portion. Seals provide sealing between the groove and the piston portion of the rod as well as between the holder and a pressure chamber wall. A pressure chamber in a hydrostatic extrusion press of the kind described in U.S. Pat. No. 3,751,958 can be used.

The invention will be described in greater detail with reference to the accompanying drawing.

High pressure cylinder 1 is formed with end members 2,3 which respectively hold high-pressure seals 4 and 5. Spacing tube 6 retains seals 4 and 5 in place. Pressure generating punch 7 is slidable within end member 2 and die support 8 is mounted at end member 3. Low pressure seal 9 provides a seal between end member 2 and pressure generating punch 7. Pressure chamber space 11 is filled with a pressure medium from a source, not shown, through channel 10. Tubular holder 12, with mandrel billet 13 mounted therein, is inserted into pressure chamber cylinder 1. Mandrel billet 13 is formed with an intermediate portion **13*a*, an attachment portion 13*b* and a piston portion 13*c*. Intermediate portion 13*a* has a smaller diameter than piston portion 13*c*, thus forming a differential piston with an annular piston surface 14 at the transition between portions 13*a* and 13*c*. The end portion 15 of holder 12 is formed with groove 16 for supporting piston portion 13*c* and with an external diameter adapted to fit the inner diameter of high pressure cylinder 1. Seal 5 seals between high pressure cylinder 1 and holder portion 15. Seal 17 seals between holder 12 and piston portion 13*c*. Annular space 18 between mandrel billet 13 and holder 12 communicates with pressure chamber space 11 through channel 19, annular space 20 between holder 12 and tube 6, and slot 21 in holder 12. Attachment portion 13*b* rests against seat 22 at the interior part of holder 12 and retains mandrel billet 13 in holder 12. Space 23 between piston portion 13*c* of mandrel billet 13 and die support 8 communicates with the atmosphere outside the die support through channel 24**.

The elongation of intermediate portion **13*a* of mandrel billet 12 is achieved by pushing pressure generating punch into pressure chamber space 11 to create an increase of pressure in the enclosed pressure medium. The pressure medium which acts on annular piston surface 14 generates a tensile force which, when the pressure has reached a certain level, exceeds the yield stress point of the material and effects a permanent elongation thereof in intermediate portion 13*a*. The maximum elongation is determined by the distance between piston portion 13*c* of mandrel billet 13 and die support 8**.

A rod material manufactured by isostatic hot pressing from the previously mentioned material has, at room temperature, a yield stress point $\sigma_S 0.1 \cong 1000$ N/mm², an ultimate strength $\sigma_B = 1400$ N/mm², an elongation of about 20% and a contraction of about 25%, and at 760° C a yield stress point $\sigma_S 0.2 \cong 970$ N/mm², an ultimate strength $\sigma_B$ 1080 N/mm², and elongation $\delta$ of about 8% and a contraction $\chi$ about 14%. Elongation is measured on a length of five times the diameter.

In corresponding tests of material which were elongated 10% the following test values were obtained:

| | $\sigma_S 0.2$ N/mm² | $\sigma_B$ N/mm² | $\delta$ % | $\chi$ % |
|---|---|---|---|---|
| Room temperature | 1493 | 1630 | 15 | 18 |
| 550° C | 1234 | 1474 | 18 | 28 |
| 650° C | 1205 | 1372 | 18 | 27 |

-continued

| | $\sigma_S$ 0.2 N/mm² | $\sigma_B$ N/mm² | δ % | χ % |
|---|---|---|---|---|
| 760° C | 1182 | 1259 | 19 | 28 |

When testing material which was elongated 14% the following test values were obtained:

| | $\sigma_S$ 0.2 N/mm² | $\sigma_B$ N/mm² | δ % | χ % |
|---|---|---|---|---|
| 550° C | 1330 | 1482 | 15 | 15 |
| 650° C | 1228 | 1445 | 17 | 25 |
| 760° C | 1225 | 1282 | 17 | 27 |

Mandrel billets having a diamater of up to 40 mm have been elongated by the method and apparatus of the invention. The required force was 170–200 tons, which was easily achieved. At 1000 Mpa there is only required a ring surface 14 of about 20 mm².

What is claimed is:

1. A method of plastically de-forming material in a high pressure cylinder provided with a pressure chamber, the material being pre-formed into a mandrel billet with an attachment portion and a piston at respective opposite ends thereof and interconnected by an intermediate portion having a smaller cross section than said piston, comprising the steps of:

fixedly securing said attachment portion by inserting a holder in said pressure cylinder including a seat for receiving said attachment portion and a groove for slidably engaging said piston, with said mandrel billet mounted in said holder, positioning said high pressure cylinder with said groove communicating with the atmosphere outside said high pressure cylinder;

filling the pressure chamber with a pressurizable pressure medium; and pressurizing said pressure chamber by movement of a pressure generating punch therein, whereby the pressure medium acts via the holder on the transition surface between the intermediate portion and said piston and causes an elongation of the intermediate portion of said mandrel billet.

2. A method as in claim 1 further comprising the step of initially mounting said mandrel billet into said holder.

3. A method as in claim 1 wherein the ambient pressure in said pressure chamber is equal to or greater than 100 MPa.

4. A method as in claim 2 wherein said material is a superalloy for an extrusion mandrel elongated between 10 and 20%.

5. A method as in claim 2 wherein the pressure in said pressure chamber is substantially 1000 MPa and said transition surface has an area of approximately 20 mm².

* * * * *